United States Patent [19]

Morel

[11] Patent Number: 4,779,747

[45] Date of Patent: Oct. 25, 1988

[54] CONTAINER HAVING A STOPPER FOR THE CONTAINER

[76] Inventor: Simone Morel, 15 rue du Faubourg de Paris, 51210 Montmirail, Marne, France

[21] Appl. No.: 88,015

[22] Filed: Aug. 18, 1987

[30] Foreign Application Priority Data

Sep. 16, 1986 [FR] France ..... 86 12919

[51] Int. Cl.[4] ..... B65D 55/02

[52] U.S. Cl. ..... 215/206; 215/221

[58] Field of Search ..... 215/206, 221, 217, 274; 220/319

[56] References Cited

U.S. PATENT DOCUMENTS 2,908,413 10/1959 O'Donnell ..... 215/221
3,407,954 10/1968 Millis ..... 215/206
3,450,290 6/1969 Turner ..... 215/206 X

*Primary Examiner*—Donald F. Norton
*Attorney, Agent, or Firm*—Browdy and Neimark

[57] ABSTRACT

The neck of a flask has an upper portion with a thread adapted for cooperating with an internal thread of a cylindrical screw cap. The cap has a lower portion carrying a radial male key which bears on a lower portion of the neck of the flask when the cap is screwed onto said neck; at least two concentrical annuluses are held by an inner ring in a cylindrical groove of the flask, and also in a groove formed in an upper portion of the lower annulus for the mobile annulus. The two annuluses are each formed with a walled passage for disengagement of the radial male key when the cap is unscrewed from the neck of the flask. The screw cap and the concentrical annuluses each having a guiding mark for vertical alignment of the male key and the walled passages.

2 Claims, 1 Drawing Sheet

CONTAINER HAVING A STOPPER FOR THE CONTAINER

BACKGROUND OF THE INVENTION

This invention relates to a safety cap forming a stopper for flasks and other containers in metal, glass or plastics materials, containing noxious or dangerous products, and having to be provided with a safety sealing device so that children or un-experienced persons will not be able to open them.

Safety closing devices are already known, but they do not meet imposed standards or are so difficult to actuate that the users close them badly, the result being a significant risk, particularly when the flasks or other containers fall in the hand of children or un-experienced persons.

OBJECT OF THE INVENTION

The invention has for its object to provide a container with a safety cap having the following main features:

(a) the cap has a lower portion carrying a radial male key which normally bears on a lower portion of the neck of the container when the cap is screwed onto this neck;

(b) at least two concentrical annuluses, with a lower annulus being maintained by an inner ring thereof in a circular groove of the container, and an upper annulus being maintained by an inner ring thereof in a groove formed in the upper portion of the lower annulus, these two annuluses rotating freely with respect to one another and to the container;

(c) the two annuluses are each formed with a walled passage for the disengagement of the male key when the cap is unscrewed from the neck of the container (d) the screw cap and the concentrical annuluses each have a guiding mark for a vertical alignment of the male key with the walled passages for removing the cap from the neck of the container.

Various other features of the invention will become more apparent from the following detailed description.

BRIEF DESCRIPTION OF THE DRAWINGS

Embodiments of the invention are shown by way of non limiting examples in the accompanying drawings, wherein.

DETAILED DESCRIPTION OF THE INVENTION

Figure 1:
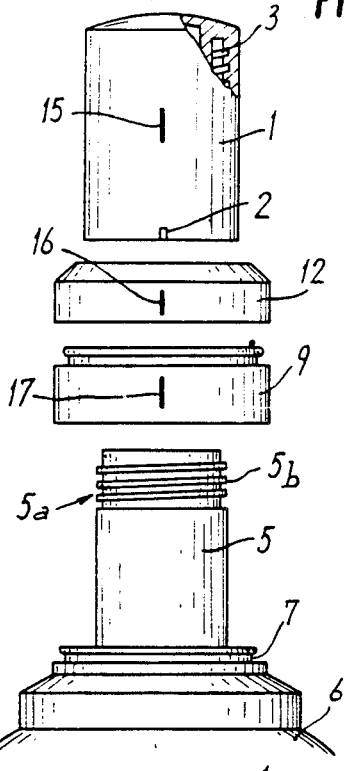
FIG. 1 is an exploded elevation view of an upper part of a flask forming container provided with a safety cap.
Figure 2:
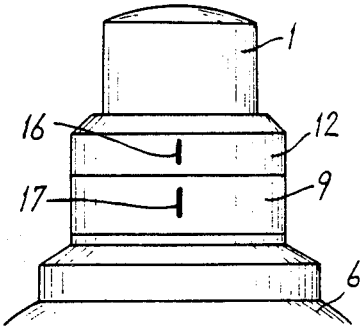
FIG. 2 shows an elevation view of the safety cap when closed.

Referring now to the drawings, FIG. 1 shows a cylindrical screw cap 1 including at its base a radial male key 2 and in its inner upper portion an internal thread 3. Advantageously, the cap 1 insidely comprises a skirt 4 FIG. 3 adapted for penetrating inside a neck 5 of a flask 6 in order to ensure its tight closing. The neck 5 is formed on its upper portion 5*a* with a thread 5*b* adapted for cooperating with the internal thread 3 of the cap 1.

Figure 3:
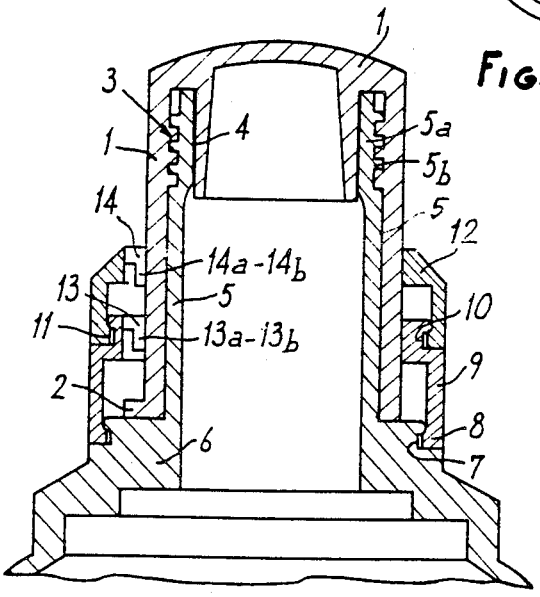
FIG. 3 is an enlarged diametrical cross-sectional view of the safety cap of FIG. 2.

As better shown in FIG. 3, the neck 5 of the flask 6 is formed at its base with a cylindrical groove 7 in which is engaged an inner ring 8 of a lower and mobile annulus 9. The upper portion of the annulus 9 is formed with a circular groove 10 in which penetrates an inner ring 11 formed at a lower portion of a second mobile annulus 12 which stands on the annulus 9. Normally, the two annuluses 9 and 12 can rotate on themselves with respect to the neck 5 of the flask 6 and also freely with respect to one another.

Figure 4:
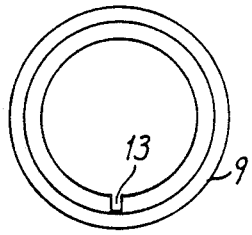
FIG. 4 is a plan view of a component of the cap.
Figure 5:
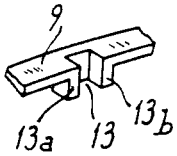
FIG. 5 is an enlarged cross sectional view of a part of the component of FIG. 4.

Each annulus 9, 12 comprises a walled passage 13, 14 (see FIGS. 3–5) adapted for a disengagement in the vertical direction of the male key 2 in cap 1. Each walled passage 13, 14 is formed with vertical turned-down parts 13*a*, 13*b* or 14*a*, 14*b*.

At this point, two remarks should be made:

(a) the width of the walled passages 13, 14 is slightly larger than the thickness of the male key 1;

(b) markings 15, 16, 17 are carried:

(1) by the screw cap 1, (2) by the upper mobile annulus 12, and (3) by the lower annulus 9 in order to provide for a vertical alignment of the male key 2 with the two walled passages 13, 14.

When the cap 1 is in a position shown in FIG. 3, the cap 1 being screwed onto the neck 5 of the flask 6, the male key 2 is not in alignment with the walled passages 13, 14 of the mobile annuluses 9 and 12, and the flask is thereby perfectly sealed.

If for some reason the cap 1 is unscrewed, it is not possible to remove it vertically as long as the markings 16, 17 are not in alignment with the marking 15 since the male key 2, in such a case, cannot pass through the annuluses 9 and 12.

For opening the flask, it is necessary first to unscrew completely the cap 1 so that it rotates freely, then to bring in alignment the three markings 15, 16 and 17, and then, by exerting a slight pressure so as to disengage the male key 2 from the annulus 9, to remove vertically the cap 1 in order to bring the male key 2 to pass through the two walled passages 13, 14.

This procedure is reversed for rescrewing the cap.

Figure 6:
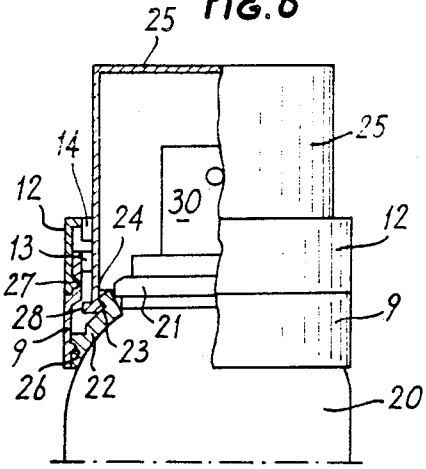
FIG. 6 is an elevation view, partly in cross-section, of the safety cap mounted on an aerosol can.

In FIG. 6, an aerosol can 20 is typically provided with a V-shaped edge 21 on which is placed a ring 22 formed on its upper portion with an external thread 23 adapted for cooperating with an internal thread 24 of the screw cap 25.

The annuluses 9 and 12 are retained in grooves 26, 27 of the ring 22 and of the annulus 9, respectively. The annuluses 9 and 12 can rotate freely with respect to one another.

The cap 25 is formed with a male key 28 similar to the male key 2 of FIGS. 1–5, and the annuluses 9 and 12 have walled passages 13, 14. Markings (not shown but similar to the marking 15, 16, 17, of FIGS. 1 and 2) are provided for the alignment of the annuluses 9 and 12 with the cap 25 in order to remove the cap. The operation of the safety cap according to FIG. 6 is identical to that of FIG. 1.

Thus, when the cap 25 is screwed and closed, spray control means 30 of the aerosol can cannot be actuated as shown in FIG. 6.

What is claimed is:

1. A container having a safety screw cap forming a stopper for said container, in which a neck of said container has an upper portion with a first thread adapted for cooperating with a second thread formed on said cap, and wherein:

(a) said cap has a lower portion with said lower portion carrying a radial male key which normally bears on a lower portion of said neck of said container when said cap is screwed onto said neck;

(b) at least two concentrical mobile annuluses are provided, with an upper annulus of said annuluses having means rotatively cooperating with means of a lower annulus of said annuluses, and said lower annulus having means rotatively cooperating with means of said container, whereby said annuluses can rotate freely with respect to one another and with respect to said container, (c) said annuluses are each formed with a walled passage for a disengagement of said radial male key when said cap is unscrewed from said neck of said container, (d) said cap and said annuluses each have a guiding mark for a vertical alignment of said male key with said walled passages in order to provide for removal of said cap from said neck of said container.

2. A container according to claim 1, wherein said container is an aerosol can and wherein said can is provided with a ring engaged in a circular edge of the can, said ring having means rotatively cooperating with said means of said lower annulus and forming said means of the container, so as to provide for a correct holding of the annuluses and a screwing of the cap.

* * * * *